US011268685B1

(12) United States Patent
Peng

(10) Patent No.: US 11,268,685 B1
(45) Date of Patent: Mar. 8, 2022

(54) BALLOON LAMP

(71) Applicant: Dongguan HJ Reform LED Ltd., Dongguan (CN)

(72) Inventor: Yao Peng, Dongguan (CN)

(73) Assignee: DONGGUAN HJ REFORM LED LTD., Dongguan (CN)

( * ) Notice: Subject to any disclaimer, the term of this patent is extended or adjusted under 35 U.S.C. 154(b) by 0 days.

(21) Appl. No.: 17/169,040

(22) Filed: Feb. 5, 2021

(30) Foreign Application Priority Data

Dec. 29, 2020 (CN) ..... 202011587061.4

(51) Int. Cl.

| | |
|---|---|
| ***F21V 29/67*** | (2015.01) |
| ***F21V 29/10*** | (2015.01) |
| ***F21V 17/10*** | (2006.01) |
| ***F21V 3/02*** | (2006.01) |
| ***F21V 23/00*** | (2015.01) |

(Continued)

(52) U.S. Cl.

CPC ..... *F21V 29/67* (2015.01); *F21V 3/02* (2013.01); *F21V 3/026* (2013.01); *F21V 17/108* (2013.01); *F21V 17/12* (2013.01); *F21V 23/001* (2013.01); *F21V 23/009* (2013.01); *F21V 23/04* (2013.01); *F21V 29/10* (2015.01)

(58) Field of Classification Search

CPC . F21V 3/02; F21V 3/023; F21V 3/026; F21V 29/67; F21V 29/673; F21V 29/677; F21V 17/108; F21V 17/12; F21V 23/001; F21V 23/009; F21V 23/04; F21V 29/10

See application file for complete search history.

(56) References Cited

U.S. PATENT DOCUMENTS 6,612,711 B1 * 9/2003 Hagenbach ..... F21V 3/026 362/96
7,264,382 B2 * 9/2007 Yoshimori ..... F21V 11/04 362/431

(Continued)

FOREIGN PATENT DOCUMENTS

JP 2013020953 A * 1/2013
WO WO-2008030138 A2 * 3/2008 ..... F21V 3/023

OTHER PUBLICATIONS

Onishi et al., "Balloon Type Floodlight", Jan. 31, 2013, J-Plat Pat, English Translation to JP,2013-020953,A, 22 Pages. (Year: 2013).*

(Continued)

*Primary Examiner* — Alan B Cariaso
(74) *Attorney, Agent, or Firm* — Sinorica LLC

(57) ABSTRACT

A balloon lamp includes a main body and a balloon cover, and the main body includes a lamp housing and a lamp body. The lamp body is fixed to the bottom of the lamp housing; the lamp housing has a fan device; the balloon cover is detachably installed to the lamp housing for storing the lamp body; an inlet is formed at the middle of the top wall of the lamp housing and communicated with a containing cavity of the lamp housing, and aligned with the filter device; the lamp body includes a circular radiator and a power supply device installed in the radiator. The top wall of the lamp housing has a filter device aligned with the air inlet and can prevent dust or powder from entering into the lamp housing; and the circular radiator and the power supply device drive the fan device to blow air continuously.

8 Claims, 6 Drawing Sheets

(51) Int. Cl.
*F21V 23/04* (2006.01)
*F21V 17/12* (2006.01)

(56) References Cited

U.S. PATENT DOCUMENTS

| | | | | |
|---|---|---|---|---|
| 7,621,650 | B2 * | 11/2009 | Nalitchaev | F21S 8/083 362/96 |
| 2006/0098421 | A1 * | 5/2006 | Fireman | F04D 25/084 362/96 |
| 2007/0019403 | A1 * | 1/2007 | Boghossian | F21V 3/023 362/157 |
| 2011/0216536 | A1 * | 9/2011 | Okazaki | F21V 7/24 362/235 |
| 2013/0128561 | A1 * | 5/2013 | Thomas | F21V 21/30 362/157 |
| 2015/0078005 | A1 * | 3/2015 | Renn | F21V 5/046 362/294 |
| 2018/0128435 | A1 * | 5/2018 | Workman | F21V 21/30 |
| 2019/0107259 | A1 * | 4/2019 | Doberstein | F21V 23/02 |
| 2020/0332978 | A1 * | 10/2020 | Palumbo | F21S 8/08 |
| 2021/0011356 | A1 * | 1/2021 | Ho | G03B 15/06 |

OTHER PUBLICATIONS

Alexandrovich et al., "Lighting Plant 'Light Balloon'", Mar. 13, 2008, WIPO IP Portal, English Translation of WO2008030138 Description, 4 Pages. (Year: 2008).*

Alexandrovich et al., "Lighting Plant 'Light Balloon'", Mar. 13, 2008, WIPO IP Portal, English Translation of WO2008030138 PCT Biblio Data, 2 Pages. (Year: 2008).*

* cited by examiner

BALLOON LAMP

BACKGROUND OF INVENTION

Field of Invention

The present invention relates to the technical field of lighting devices, in particular to a balloon lamp.

Description of the Related Art

Balloon lamp with the features of light weight, convenient transportation, and small volume is used extensively in malls, outdoor, squares, and stages.

In general, a conventional balloon lamp includes a main body and a balloon cover, and the main body includes a lamp housing and a lamp body, and the lamp body is fixed to the bottom of the lamp housing, and the lamp housing contains a power supply device, a fan device, and an air inlet formed on a side of the lamp housing, but the structural design of such balloon lamp has the following problems: 1. The power supply device is installed in the lamp housing, and thus has a low cooling effect and a short service life; 2. The air inlet is arranged on a side of the lamp housing, and thus dust or powder in air cannot be prevented from entering the lamp housing.

Obviously, the conventional balloon lamp requires further improvements.

SUMMARY OF THE INVENTION

It is a primary objective of the present invention to overcome the deficiencies of the prior art by providing a balloon lamp with good cooling effect and long service life.

To achieve the aforementioned and other objectives, the present invention discloses a balloon lamp comprising a main body and a balloon cover, and the main body comprises a lamp housing and a lamp body fixed to the bottom of the lamp housing, and the lamp housing has a fan device installed in the lamp housing, and the balloon cover is detachably installed to a side of the lamp housing and stored in the lamp body. An air inlet is formed at the middle of a top wall of the lamp housing and communicated with a containing cavity of the lamp housing, and a filter device installed to the top wall of the lamp housing and configured to be corresponsive to the air inlet; and the lamp body has a circular radiator, and the radiator includes a power supply device installed in the radiator.

In the present invention, the fan device includes at least one fan or blower.

The present invention further comprises a Velcro® tape including a Velcro® hook surface and a Velcro® loop surface, and the Velcro® hook surface is disposed on an outer circumferential surface of the top of the lamp housing, and the Velcro® loop surface is disposed on an inner wall of the installation opening of the balloon cover, and the Velcro® hook surface and the Velcro® loop surface match with each other.

The present invention further comprises a Velcro® safety screw sequentially passing through the Velcro® hook surface and an installation hole of the lamp housing to fix the Velcro® hook surface and the lamp housing together.

In the present invention, the filter device comprises a filter cover, a filter drawer and a filter sponge, and the filter sponge is disposed in the filter drawer, and the filter cover is disposed above the filter drawer and coupled to the filter drawer through the non-loosable spring riveted thumb screw, and the filter cover is fixed onto the top wall of the lamp housing.

In the present invention, the top wall of the lamp housing has a handle.

In the present invention, the containing cavity of the lamp housing has a cylindrical partition that separates the containing cavity of the lamp housing into an air inlet area communicated with the air inlet and air outlet area communicated with the ventilation channel in the lamp body, and the balloon cover has a plurality of air outlets communicated with the ventilation channel.

In the present invention, the power supply device is installed onto the power supply mounting plate, and the power supply mounting plate is installed onto an inner wall of the radiator.

In the present invention, the top wall of the lamp housing has a cable electrically coupled to the power supply device, and the cable has a waterproof cable connector disposed proximate to the lamp housing, and the top wall of the lamp housing further has a cable insulation clamp for preventing the cable from becoming unstable or loosened.

In the present invention, the top wall of the lamp housing has a dimmer for controlling a change of brightness of the lamp body and a switch for controlling the ON/OFF of the power supply device.

Compared with the prior art, the present invention has the following advantageous effects:

With the aforementioned structural design, the top wall of the lamp housing has a filter device installed thereon and configured to be corresponsive to the air inlet, so as to effectively prevent dust or powder in air from entering into the lamp housing. The lamp body comprises a circular radiator and a power supply device installed in the radiator, so that the fan device continues blowing air to maintain a certain air pressure of the balloon cover, ensuring the integrity and fullness of the shape of the balloon cover, and cooling the power supply device and the lamp body, while cooling the power supply device and the lamp body, and such arrangement not just provides a good cooling effect only, but also improves the service life of the balloon lamp.

BRIEF DESCRIPTION OF THE DRAWINGS

The present invention will become clearer in light of the following detailed description of an illustrative embodiment of this invention described in connection with the drawings.

BRIEF DESCRIPTION OF NUMERALS USED IN THE DRAWINGS

Figure 1:
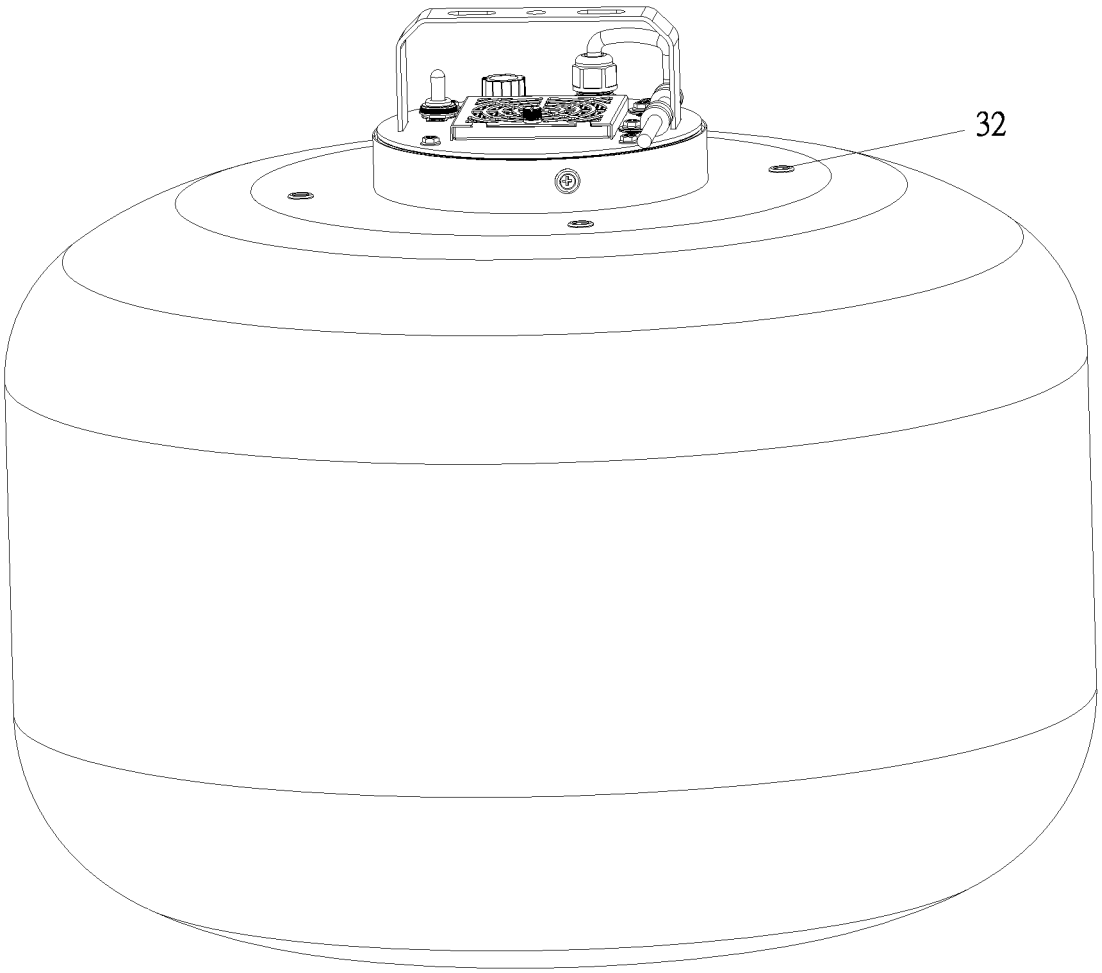
FIG. 1 is a schematic view showing the structure of an embodiment of the present invention.

10: Lamp housing; 20: Lamp body; 30: Balloon cover; 40: Fan device; 50—Radiator, 60: Filter device, 70: Velcro® tape; 80: Power supply device; 11: Containing cavity; 12: Air inlet; 13: Handle; 14: Air inlet area; 15: Air outlet area; 16: Cylindrical partition; 17: Cable; 18—Waterproof cable connector; 19: Cable insulation clamp; 110: Dimmer; 111: Switch; 71: Velcro® hook surface; 72: Velcro® loop surface; 73: Velcro® safety screw; 31: Installation opening; 32: Air outlet; 61: Filter cover; 62: Filter drawer; 63: Filter sponge; 64: Non-loosable spring riveted thumb screw; 21: Ventilation channel; 81: Power supply mounting plate; 82: Connecting plate.

DESCRIPTION OF THE PREFERRED EMBODIMENTS

Exemplary embodiments are illustrated in referenced figures of the drawings. It is intended that the embodiments and figures disclosed herein are to be considered illustrative rather than restrictive.

It is noteworthy that similar numerals and alphabets used in the drawings represent similar items, so that once an item is defined in a drawing, and the item shown in subsequent drawings no longer needs to be discussed further.

In the description of this invention, it should be understood that the terms "center", "longitudinal direction", "transversal direction", "length", "width", "thickness", "up", "down", "front", "back", "left", "right", "erect, "level", "top", "bottom", "outside", "inside", "clockwise", "counterclockwise" etc. refer to an indicated orientation and a positional relation based on the orientation and positional relation as shown in the attached drawings. These terms are used for the purpose of describing the creation of this disclosure and simplifying the description, but not intended for indicating or implying that the device or component must have the specific position, the specific positional structure and operation, so that these terms should not be construed as a limitation on this disclosure. In addition, the terms "first", and "second" are used for the purpose of describing the invention of this disclosure and simplifying the description, but not intended for indicating or implying that the relative importance or the quantity of the technical characteristics. Therefore, the characteristic of "the first" or "the second" may expressively or implicatively include one or more of the technical characteristics. In this specification, the terms "a plurality" and "many" indicate a quantity of two or more, unless specified or limited otherwise.

In the description of the present invention, it is noteworthy that the terms "disposed", "installed", "connected", "coupled", "fixed" etc. should be interpreted broadly, unless otherwise specified and restricted clearly. For example, a connection can be a fixed connection, a detachable connection, or an integral connection, and it can also be a mechanical connection or an electrical connection, and it can also be a direct connection or an indirection connection through a medium. Persons having ordinary skill in the art should be able to understand the specific meaning of the aforementioned terms used in the present invention according to the specific circumstances.

In the description of the present invention, unless otherwise specified or limited, the expression "The first characteristic is "above" or "under" the second characteristic" includes a direct contact between the first and second characteristics, and may also include an indirect contact of the first and second characteristics through another characteristic. The expression "The first characteristic is "on", "above" and "at the top of" the second characteristic indicates that the first characteristic is disposed precisely or diagonally above the second characteristic or just indicates that level of the first characteristic is higher than that of the second characteristic. The expression "The first characteristic is "under", "below" and "at the bottom of" the second characteristic indicates that the first characteristic is disposed precisely or diagonally under the second characteristic or just indicates that level of the first characteristic is lower than that of the second characteristic.

Figure 2:
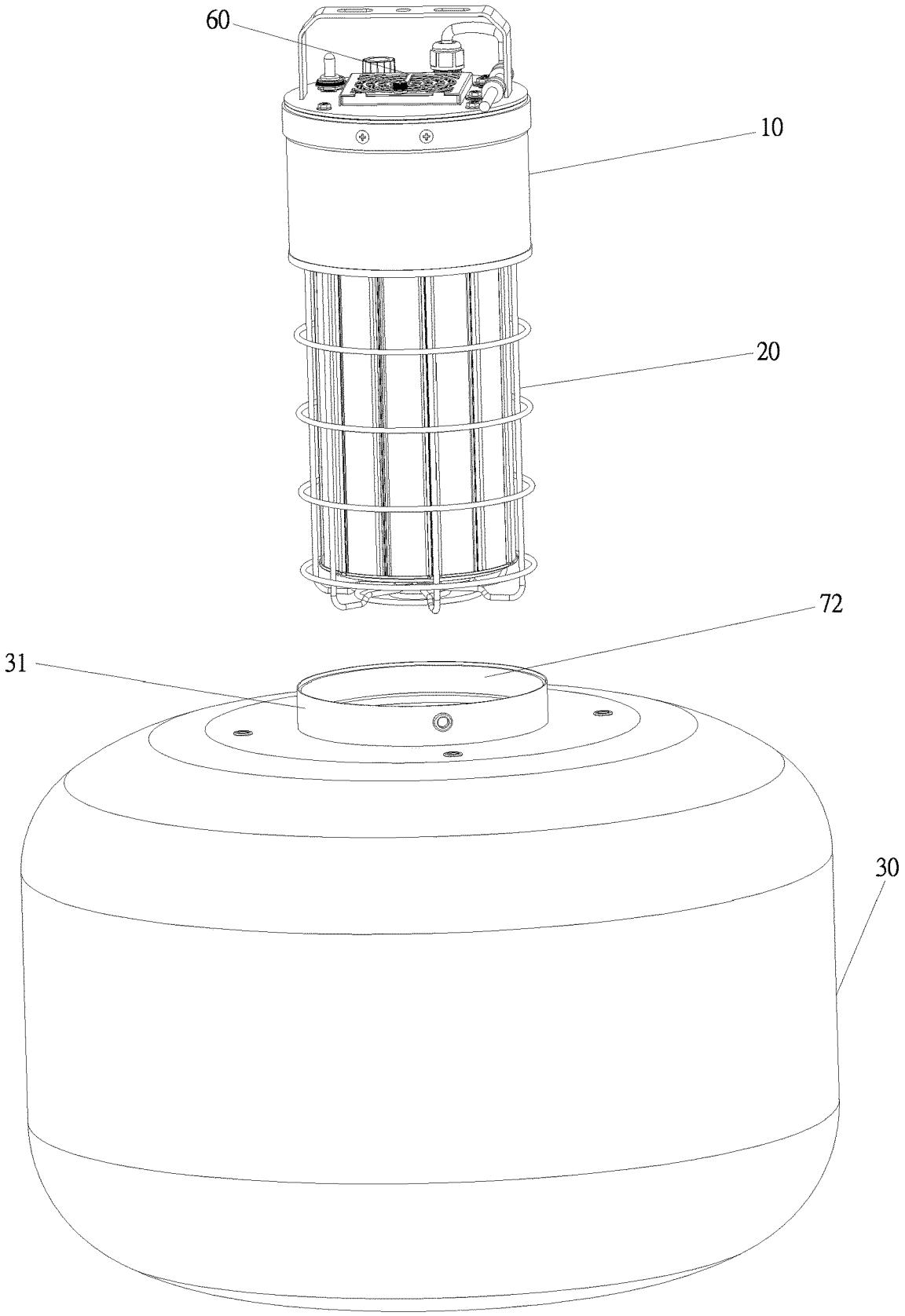
FIG. 2 is an exploded view showing the structure of an embodiment of the present invention.
Figure 3:
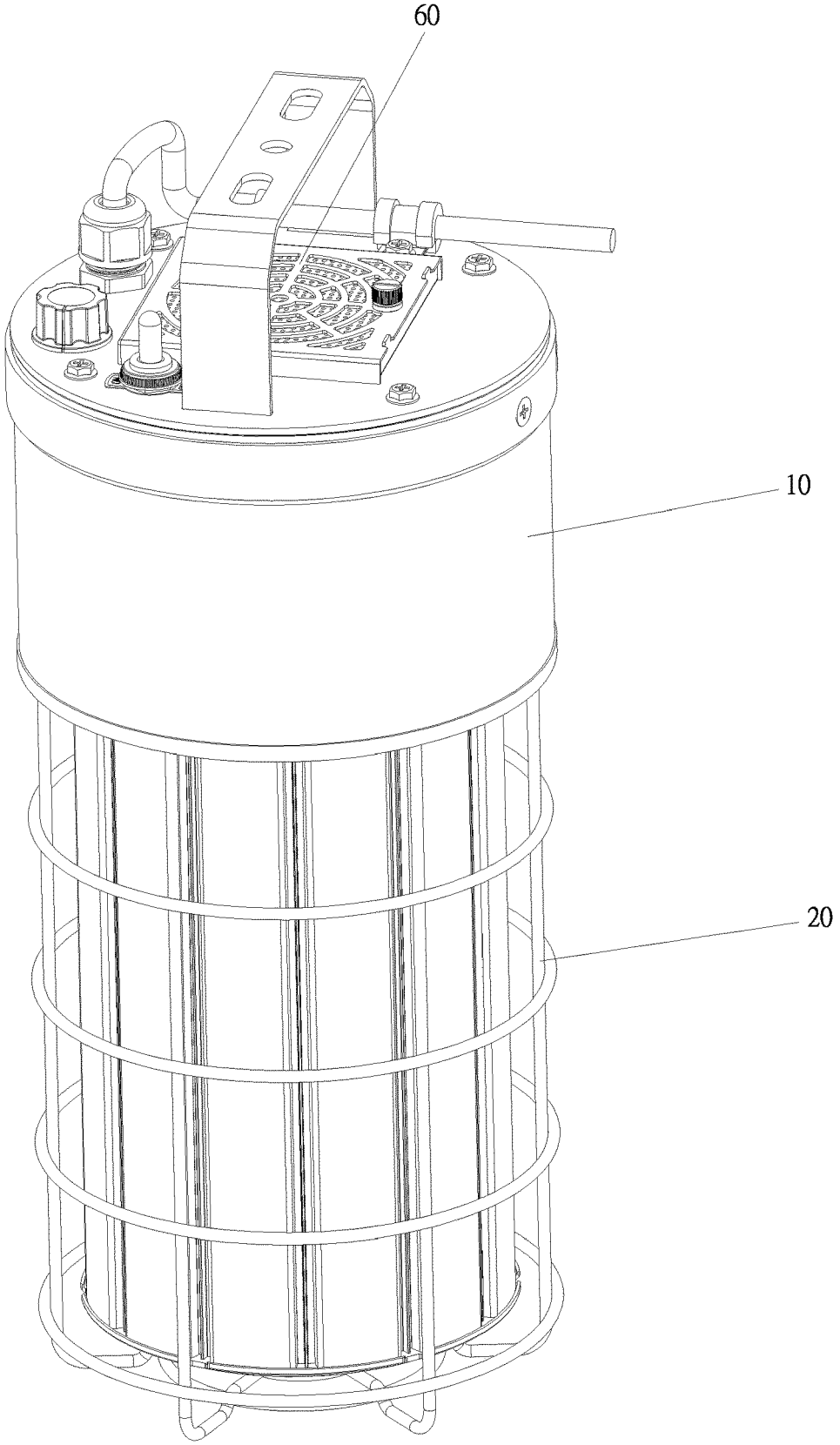
FIG. 3 is a schematic view showing the structure of a main body in accordance with an embodiment of the present invention.

With reference to FIGS. 1 and 2 for a balloon lamp of the present invention, the balloon lamp comprises a main body and a balloon cover 30, and the main body comprises a lamp housing 10 and a lamp body 20, and the lamp body 20 is fixed onto a connecting plate 82 at the bottom of the lamp housing 10, and the lamp housing 10 comprises a fan device 40, and the balloon cover 30 is detachably installed to a side of the lamp housing 10 and stored in the lamp body 20, and the top wall of the lamp housing 10 has an air inlet 12 communicated with a containing cavity 11 of the lamp housing 10 and a filter device 60 installed to the top wall of the lamp housing 10 and configured to be corresponsive to the air inlet 12;

The lamp body 20 has a circular radiator 50 installed therein, and the radiator 50 has a power supply device 80 installed therein. With the aforementioned structural design, the top wall of the lamp housing 10 has a filter device 60 installed thereon and configured to be corresponsive to the air inlet 12, so as to effectively prevent dust or powder in air from entering into the lamp housing. The lamp body 20 comprises a circular radiator 50 and a power supply device 80 installed in the radiator 50, so that the fan device 40 continues blowing air to maintain a certain air pressure of the balloon cover, ensuring the integrity and fullness of the shape of the balloon cover, and cooling the power supply device 80 and the lamp body 20, while cooling the power supply device 80 and the lamp body 20, and such arrangement not just provides a good cooling effect only, but also improves the service life of the balloon lamp.

The fan device 40 includes at least one fan or blower.

Figure 5:
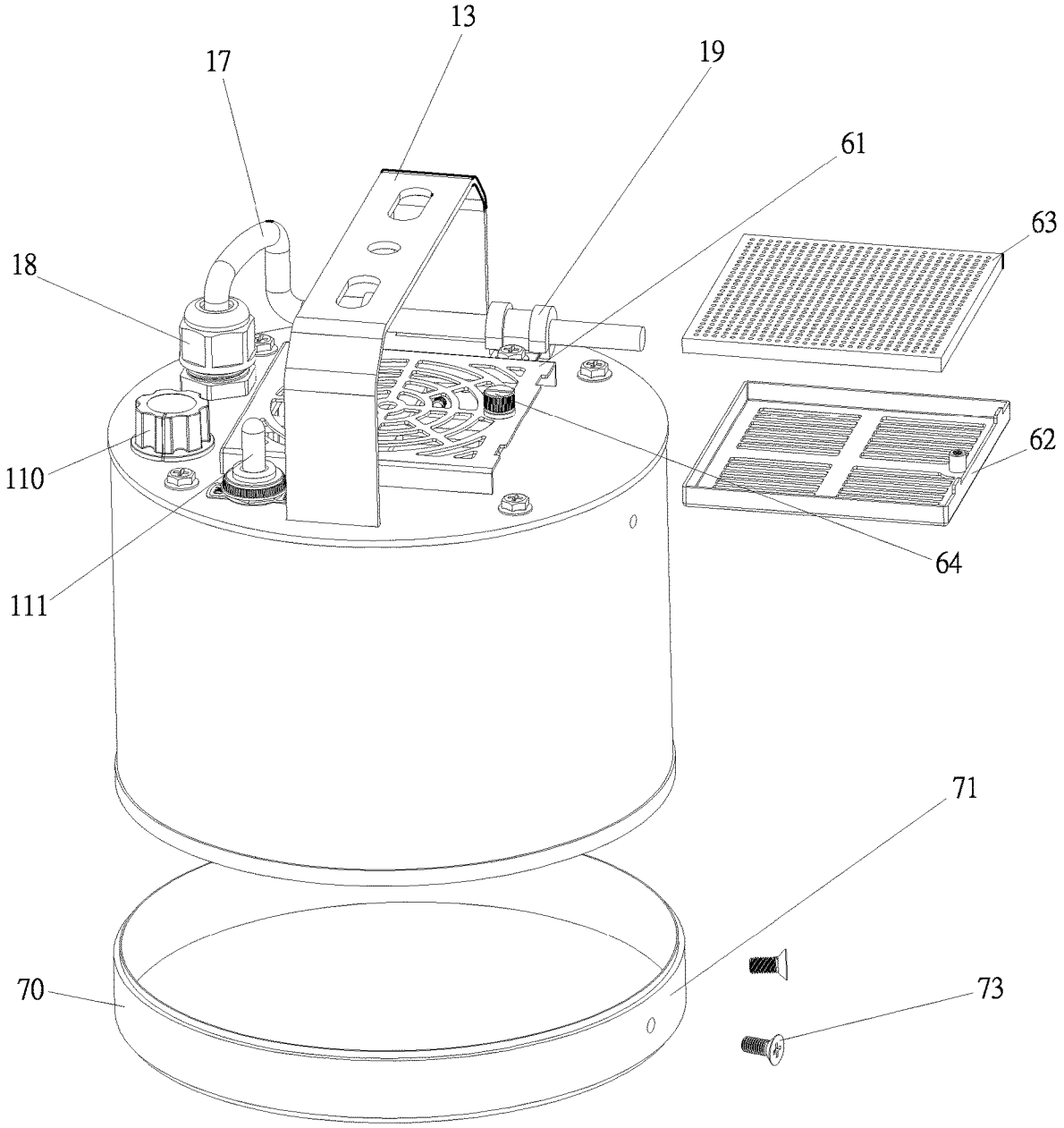
FIG. 5 is a schematic view showing the structure of a lamp housing in accordance with an embodiment of the present invention.

In FIGS. 2 and 5, the balloon lamp of the invention further comprises a Velcro® tape 70, and the Velcro® tape 70 comprises a Velcro® hook surface 71 and a Velcro® loop surface 72, and the Velcro® hook surface 71 is disposed on an outer circumferential surface at the top of the lamp housing 10, and the Velcro® loop surface 72 is disposed on an inner wall of the installation opening 31 of the balloon cover 30, and the Velcro® hook surface 71 and the Velcro® loop surface 72 are engaged with each other, so that the Velcro® tape 70 can detachably install the balloon cover 30 to a side of the lamp housing 10.

In FIG. 5, the balloon lamp of the invention further comprises a Velcro® safety screw 73 sequentially passing through the installation opening 31, the Velcro® tape 70, and the installation opening of the lamp housing 10 to fix the three together to achieve the effect of preventing the balloon cover 30 and lamp housing 10 from being loosened.

In FIG. 5, the filter device 60 comprises a filter cover 61, a filter drawer 62 and a filter sponge 63, and the filter sponge 63 is installed in the filter drawer 62, and the filter cover 61 is installed to the top of the filter drawer 62, and the filter cover 61 is coupled to the filter drawer 62 through the non-loosable spring riveted thumb screw 64, and the filter cover 61 is fixed to the top wall of the lamp housing 10. With the aforementioned structural design, the non-loosable spring riveted thumb screw 64 is loosened, and then the filter drawer 62 can be removed under the condition that the non-loosable spring riveted thumb screw 64 will not fall out, so that the filter sponge 63 can be replaced or cleaned conveniently and quickly.

In FIG. 5, the top wall of the lamp housing 10 has a handle 13, and the design of the handle 13 allows the balloon lamp of this invention to be fixed and used directly without requiring a connector.

Figure 4:
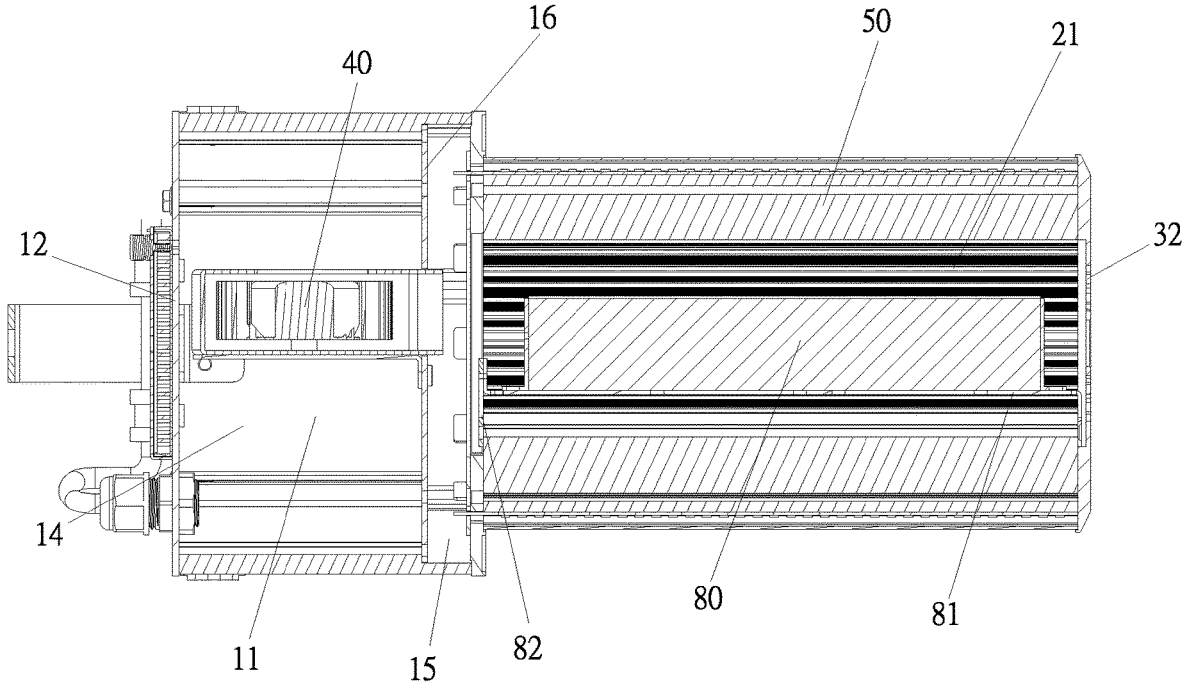
FIG. 4 is a cross-sectional view showing the structure of a main body in accordance with an embodiment of the present invention.

In FIG. 4, the containing cavity 11 of the lamp housing 10 has a cylindrical partition 16 that separates the containing cavity 11 of the lamp housing 10 into an air inlet area 14 communicated with the air inlet 12 and an air outlet area 15 communicated with the ventilation channel 21 in the lamp body 20, and the balloon cover 30 has a plurality of air outlets 32 formed thereon and communicated with the ventilation channel 21.

In FIG. 4, the power supply device 80 is installed on the power supply mounting plate 81, and the power supply mounting plate 81 is installed onto an inner wall of the radiator 50.

In FIG. 5, the top wall of the lamp housing 10 has cable 17 electrically coupled to the power supply device 80, and the cable 17 has a waterproof cable connector 18 disposed at a position proximate to the lamp housing 10, and the top wall of the lamp housing 10 further has a cable insulation clamp 19 for preventing the cable from becoming unstable or loosened.

In FIG. 5, the top wall of the lamp housing 10 has a dimmer 110 for controlling a change of brightness of the lamp body and a switch 111 for controlling the ON/OFF of the power supply device 80.

Figure 6:
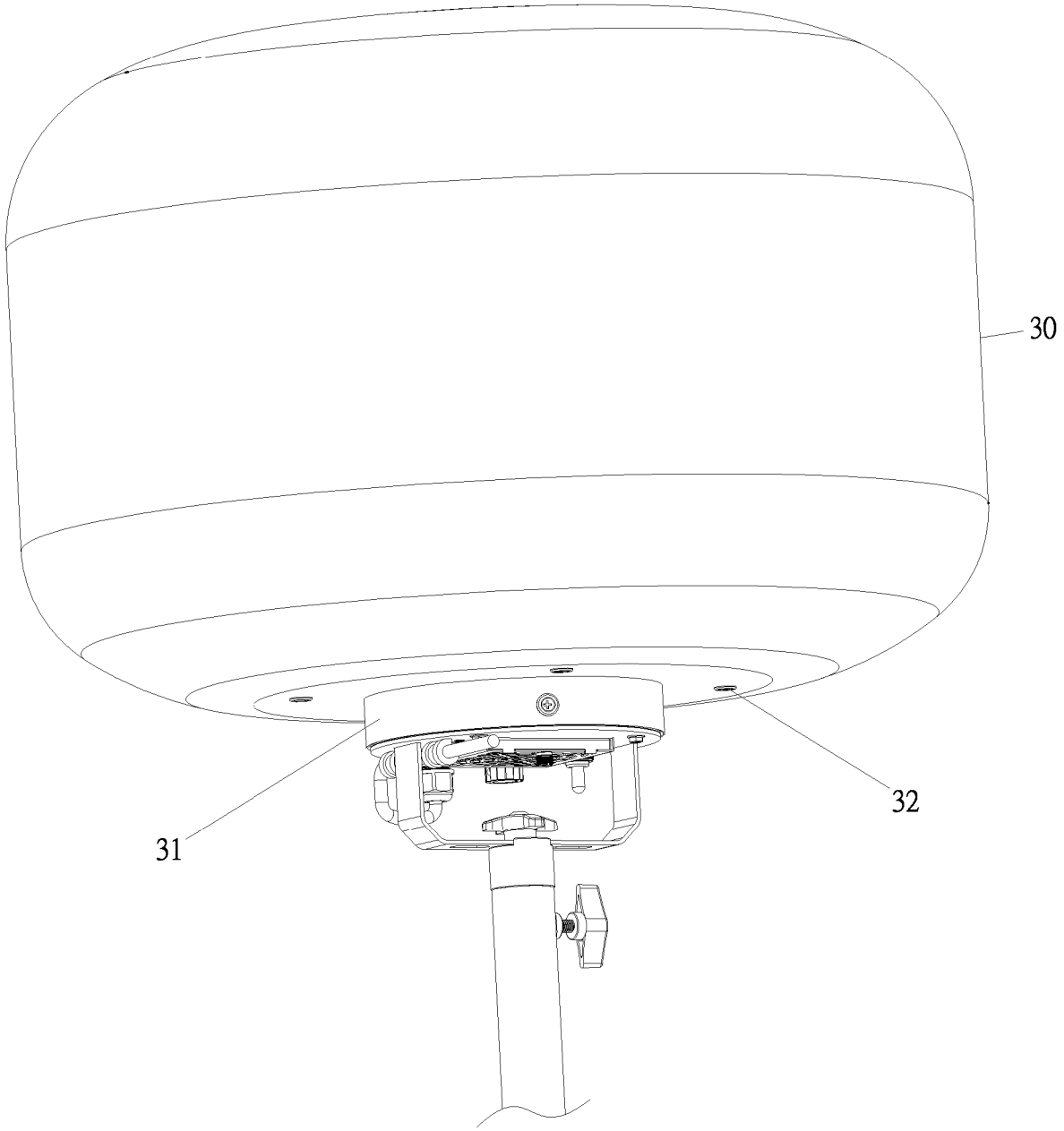
FIG. 6 is a schematic view showing an installed structure in accordance with an embodiment of the present invention.

With reference to FIG. 6 for the installation of the present invention, the handle is fixed to a moving part through the thumb screw, wherein the moving part includes but not limited to a hook, a hanging ring, a fixing column, a handle, etc. that provides the hanging, flipping, and portable functions lamp. In addition, the design of the lamp further comprises a wireless control module to facilitate the control of the lamp by using a wireless remote control switch. The main body of the balloon lamp of the present invention can be used independently or used after the balloon cover is installed to provide various ways of use.

In summation of the description above, the present invention overcomes the deficiencies of the prior art by adopting the aforementioned structural design with the features of reasonable design, good cooling effect, and long service life.

While the invention has been described by means of specific embodiments, numerous modifications and variations could be made thereto by those skilled in the art without departing from the scope and spirit of the invention set forth in the claims.

What is claimed is:

1. A balloon lamp, comprising a main body and a balloon cover, and the main body comprising a lamp housing and a lamp body fixed to the bottom of the lamp housing, and the lamp housing having a fan device installed therein, and the balloon cover being detachably installed to a side of the lamp housing and stored in the lamp body, characterized in that an air inlet is formed at the middle of a top wall of the lamp housing and communicated with a containing cavity of the lamp housing, and a filter device installed to the top wall of the lamp housing and configured to be corresponsive to the air inlet; and the lamp body has a circular radiator, and the radiator includes a power supply device installed therein;

a Velcro® tape including a Velcro® hook surface and a Velcro® loop surface, and the Velcro® hook surface being disposed on an outer circumferential surface of the top of the lamp housing, and the Velcro® loop surface being disposed on an inner wall of the installation opening of the balloon cover, and the Velcro® hook surface and the Velcro® loop surface matching with each other; and a Velcro® safety screw sequentially passing through the Velcro® hook surface and an installation hole of the lamp housing to fix the Velcro® hook surface and the lamp housing together.

2. The balloon lamp as claimed in claim 1, wherein the fan device comprises at least one fan or blower.

3. The balloon lamp as claimed in claim 1, wherein the filter device comprises a filter cover, a filter drawer and a filter sponge, and the filter sponge is disposed in the filter drawer, and the filter cover is disposed above the filter drawer and coupled to the filter drawer through the non-loosable spring riveted thumb screw, and the filter cover is fixed onto the top wall of the lamp housing.

4. The balloon lamp as claimed in claim 1, wherein the lamp housing has a handle installed to the top wall thereof.

5. The balloon lamp as claimed in claim 1, wherein the containing cavity of the lamp housing has a cylindrical partition that separates the containing cavity of the lamp housing into an air inlet area communicated with the air inlet and air outlet area communicated with a ventilation channel in the lamp body, and the balloon cover has a plurality of air outlets communicated with the ventilation channel.

6. The balloon lamp as claimed in claim 5, wherein the top wall of the lamp housing has a cable electrically coupled to the power supply device, and the cable has a waterproof cable connector disposed proximate to the lamp housing, and the top wall of the lamp housing further has a cable insulation clamp for preventing the cable from becoming unstable or loosened.

7. The balloon lamp as claimed in claim 6, wherein the top wall of the lamp housing has a dimmer for controlling a change of brightness of the lamp body and a switch for controlling the ON/OFF of the power supply device.

8. The balloon lamp as claimed in claim 1, wherein the power supply device is installed onto a power supply mounting plate, and the power supply mounting plate is installed onto an inner wall of the radiator.

* * * * *